US007513547B1

(12) United States Patent
Liu

(10) Patent No.: US 7,513,547 B1
(45) Date of Patent: Apr. 7, 2009

(54) CHOPSTICKS GRIPPER

(76) Inventor: Ming-Huang Liu, No. 24, Lane 1, Dahan St., Shengang Township, Taichung County (TW)

( * ) Notice: Subject to any disclaimer, the term of this patent is extended or adjusted under 35 U.S.C. 154(b) by 0 days.

(21) Appl. No.: 11/868,692

(22) Filed: Oct. 8, 2007

(51) Int. Cl.
*A47G 21/10* (2006.01)

(52) U.S. Cl. ..... 294/99.2; 294/1.1

(58) Field of Classification Search ..... 294/1.1, 294/5.5, 16, 99.2
See application file for complete search history.

(56) References Cited

U.S. PATENT DOCUMENTS 4,199,180 A * 4/1980 Kelly ..... 294/33
4,721,334 A * 1/1988 Nakatsu ..... 294/99.2
4,787,663 A * 11/1988 Laramie ..... 294/99.2
5,810,411 A * 9/1998 Major ..... 294/99.2
6,749,239 B2 * 6/2004 Choi ..... 294/99.2

* cited by examiner

*Primary Examiner*—Dean J Kramer
(74) *Attorney, Agent, or Firm*—Egbert Law Office PLLC

(57) ABSTRACT

The present invention provides a chopsticks gripper. The gripper includes an intermediate block containing top, bottom and four sides. A semi-angle internal gripping slot penetrating the intermediate block is arranged separately at left and right sides. The internal gripping slot is also placed obliquely. A left clamp splice is penetrated by a semi-angle first external gripping slot correspondingly to the intermediate block. A right clamp splice is penetrated by a semi-angle second external gripping slot correspondingly to the intermediate block. A flexible sleeving member, sleeved onto the intermediate block and around the left and right clamp splices, enables flexible positioning. With the chopsticks gripper, users learn how to use and hold chopsticks quickly and correctly.

3 Claims, 7 Drawing Sheets

CHOPSTICKS GRIPPER

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates generally to a chopsticks gripper, and more particularly to an innovative gripper which allows for easy holding.

2. Description of Related Art Including Information Disclosed Under 37 CFR 1.97 and 37 CFR 1.98

Given the geographical and climatic factors of Asian countries, the principal meal products (e.g. rice) and a variety of dishes are served using chopsticks and spoons.

With the booming social development and more frequent exchange with western countries, more and more western-style restaurants and snack bars are opened in Taiwan. In such cases, the children in the elementary schools who show great interest in western food have to independently learn how to use the forks and knives in a proper manner.

However, the following shortcomings are observed during actual applications:

In the modern era where economic development has benefitted from advanced technologies and foreign investment assistance, many foreign experts live and work in eastern countries but face the problem of learning how to use chopsticks expertly in everyday life and on many occasions.

Thus, to overcome the aforementioned problems of the prior art, it would be an advancement in the art to provide an improved structure that can significantly improve efficacy.

Therefore, the inventor has provided the present invention of practicability after deliberate design and evaluation based on years of experience in the production, development and design of related products.

BRIEF SUMMARY OF THE INVENTION

The enhanced efficacy of the present invention is as follows:

First, the chopsticks gripper A comprises an intermediate block 10, left clamp splice 20 and right clamp splice 30. The flexible sleeving member 40 is sleeved onto the intermediate block 10 and around the left and right clamp splices 20, 30, enabling them to be positioned flexibly. With this innovative structure, the chopsticks gripper enables users to hold and use the chopsticks in a correct manner.

Additionally, since the left and right clamp splices 20, 30 and intermediate block 10 are made of different members, the excellent variation of spacing allow it to accommodate itself to different chopsticks with improved applicability.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

FIGS. 1-7 depict preferred embodiments of chopsticks gripper A of the present invention. The embodiments are provided only for explanatory purposes. The scope of the invention is set by the patent claims.

Figure 1:
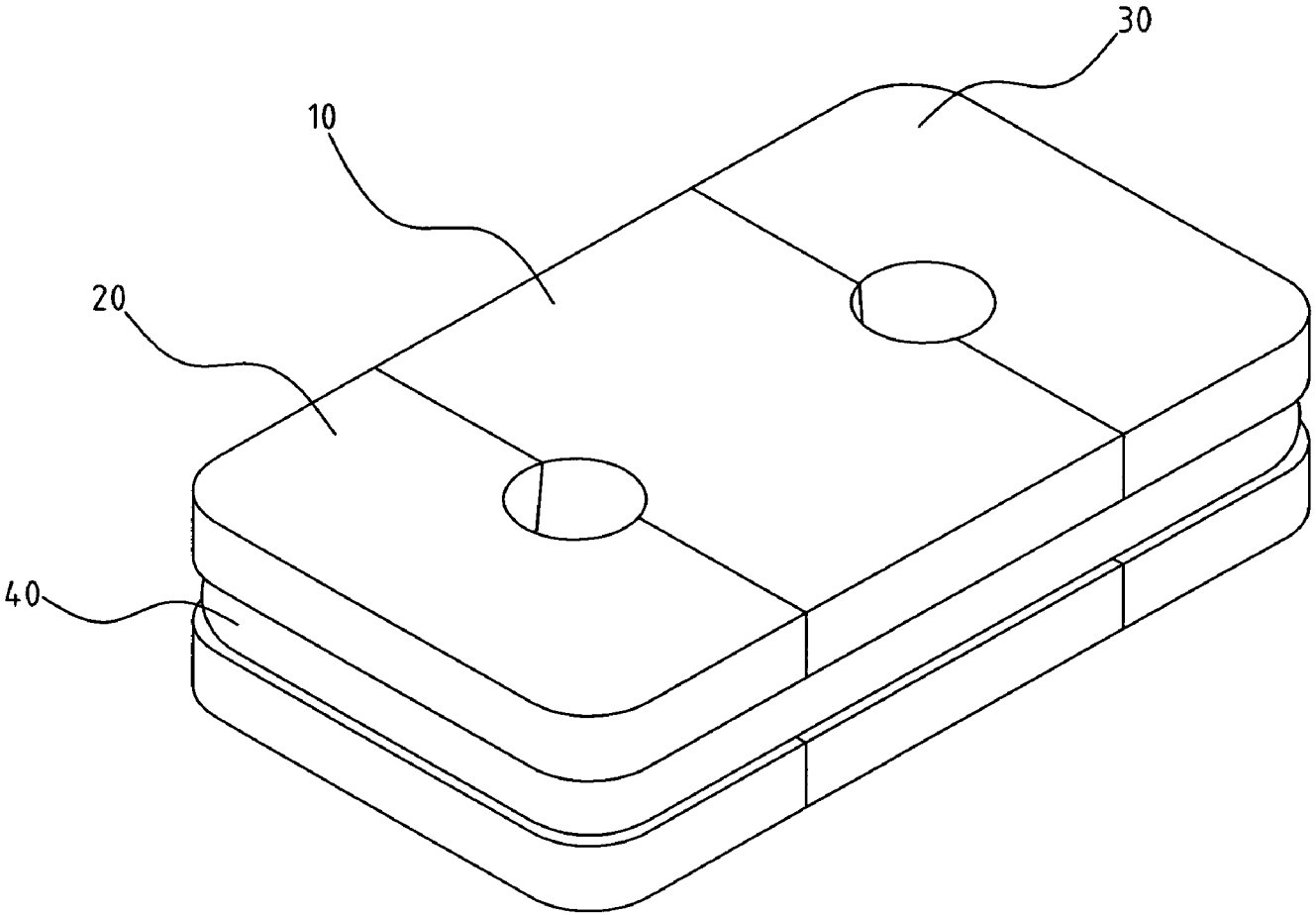
FIG. 1 shows an assembled perspective view of the present invention.
Figure 2:
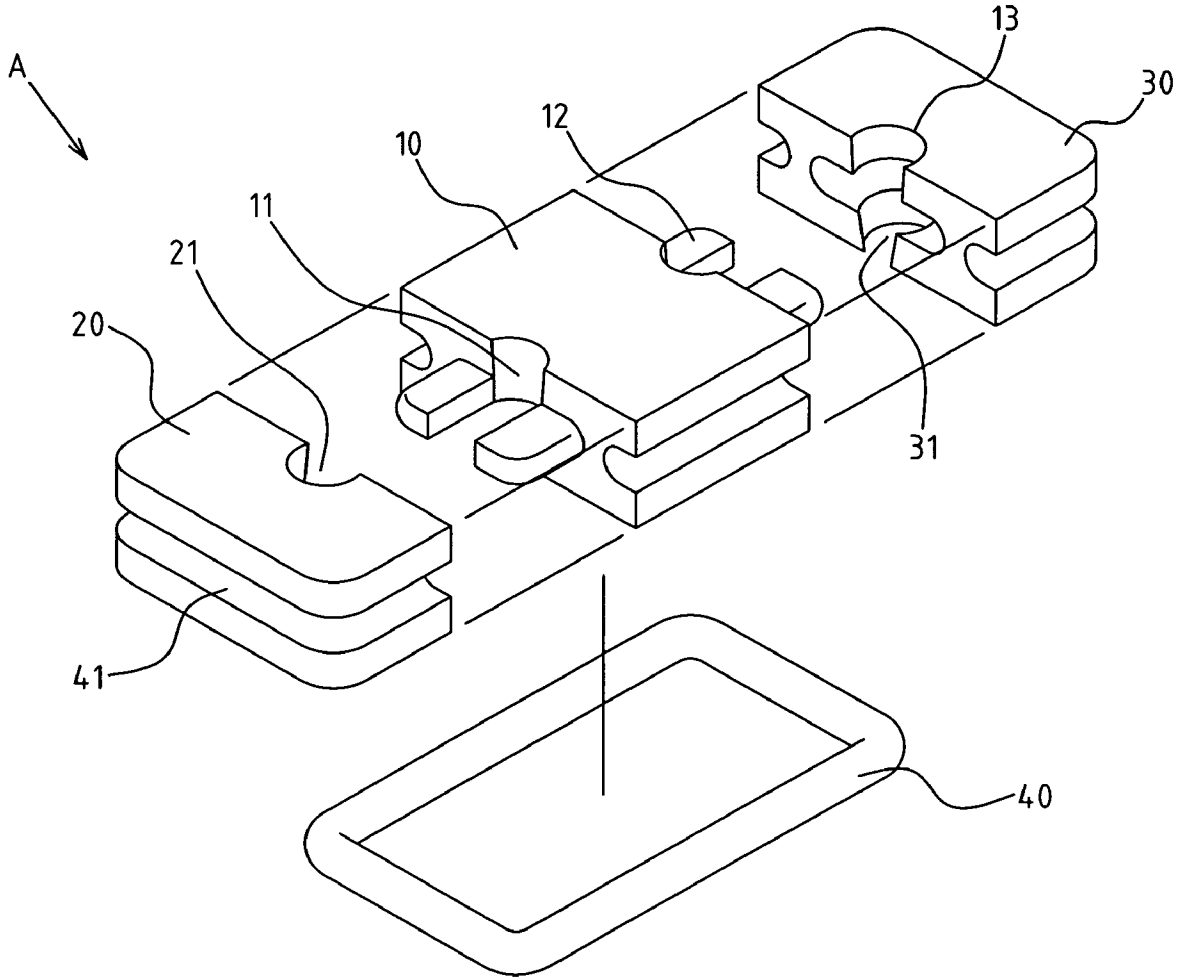
FIG. 2 shows an exploded perspective view of the present invention.
Figure 3:
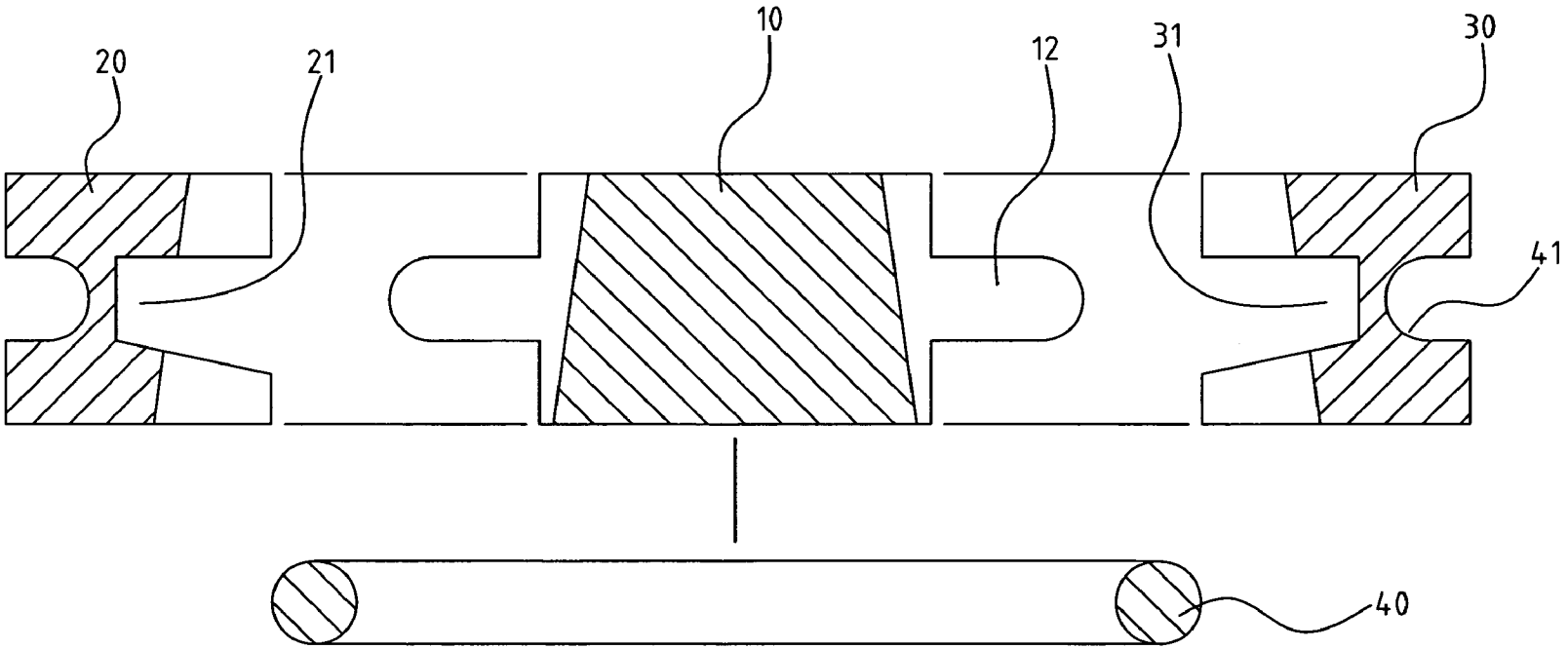
FIG. 3 shows an exploded sectional view of the present invention.
Figure 4:
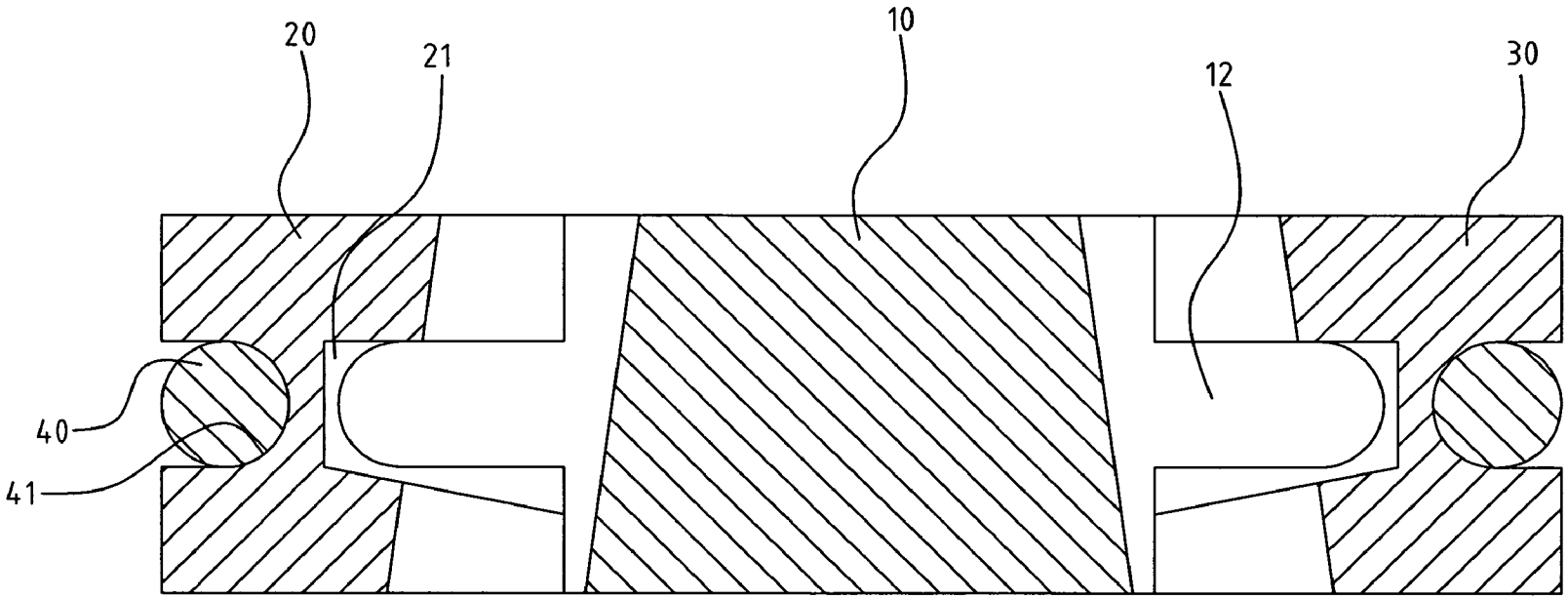
FIG. 4 shows an assembled sectional view of the present invention.

Referring to FIGS. 1 4, chopsticks gripper A comprises an intermediate block 10, which contains a top, bottom and four sides. A semi-angle internal gripping slot 11 penetrating the intermediate block 10 is arranged separately at left and right sides. The internal gripping slot 11 is placed obliquely. The lug 12 and groove 13 coupled transversely are arranged between left or right or both sides of said intermediate block 10 and the left or right or both clamp splices 20, 30.

A left clamp splice 20 is assembled at the left side of the intermediate block 10 and placed opposite to the intermediate block 10. A semi-angle first external gripping slot 21 penetrates the left clamp splice 20. The first external gripping slot 21 forms a complete through-hole by aligning with the internal gripping slot 11 at the left side of the intermediate block 10. The first external gripping slot 21 is also arranged obliquely in line with the internal gripping slot 11.

A right clamp splice 30 is assembled at the right side of the intermediate block 10 and placed opposite to the intermediate block 10. A semi-angle second external gripping slot 31 penetrates the right clamp splice 30. The second external gripping slot 31 can form a complete through-hole by aligning with the internal gripping slot 11 at the right side of the intermediate block 10. The second external gripping slot 31 is also arranged obliquely in line with the internal gripping slot 11.

A flexible sleeving member 40 is sleeved onto a recessed notch on the intermediate block 10 and around a recessed notch 41 on the left and right clamp splices 20, 30, enabling them to be positioned flexibly.

Figure 5:
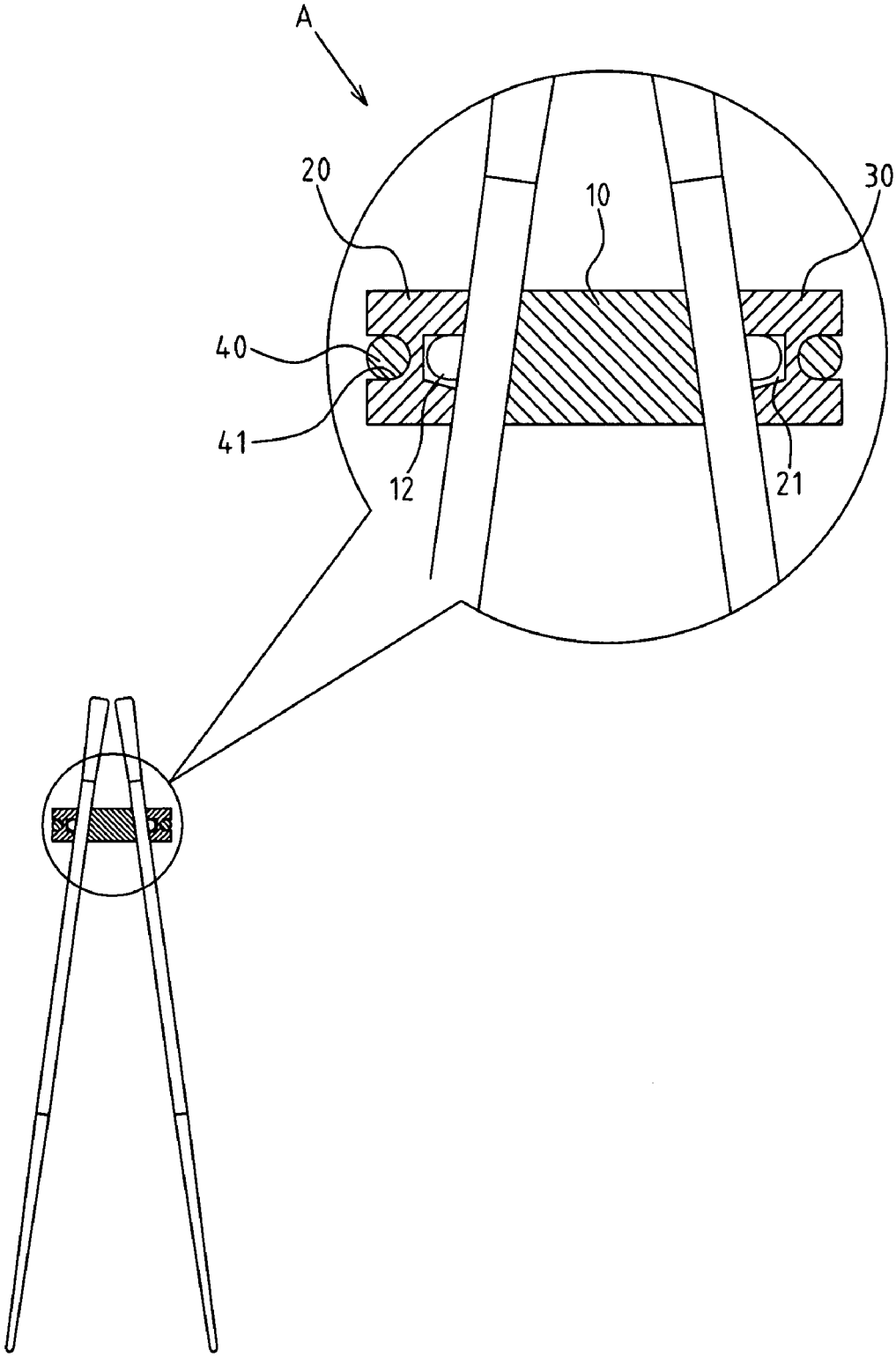
FIG. 5 shows an assembled elevation view and an isolated partial sectional view of the application of the present invention.
Figure 6:
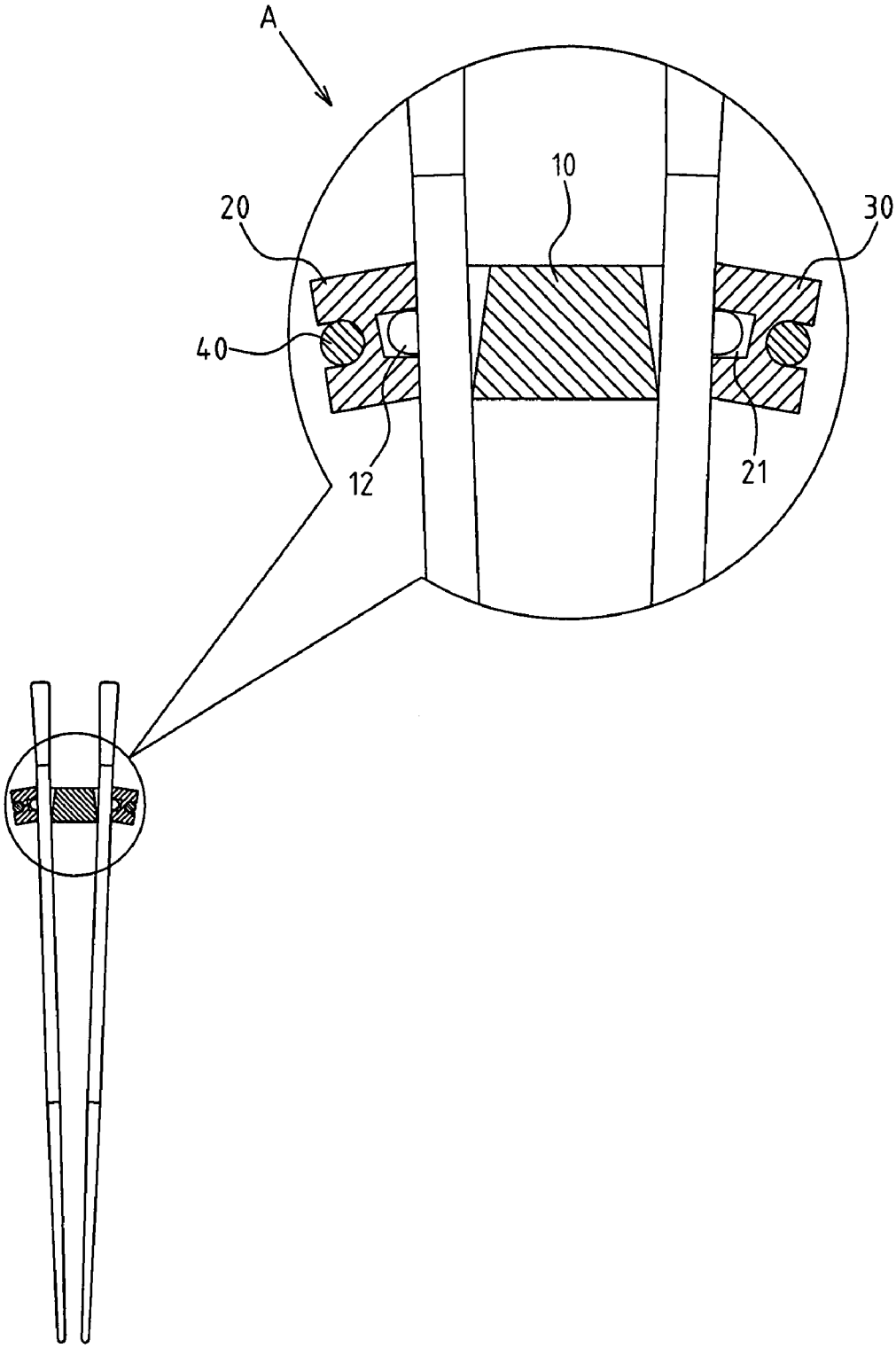
FIG. 6 shows another assembled elevation view and an isolated partial sectional view of the application of the present invention.

Based upon the above-specified structures, the present invention is operable. Referring to FIG. 5, when chopsticks are inserted into the chopsticks gripper A, the chopsticks are normally in an open state since the internal gripping slot 11 of intermediate block 10 is obliquely placed in line with the first and second external gripping slots 21, 31 of the left and right clamp splices 20, 30. Referring also to FIG. 6, when a closing force is applied to the chopsticks, the chopsticks in the through-holes are pushed towards both oblique surfaces so that the ends of the chopsticks are in a closed state.

Figure 7:
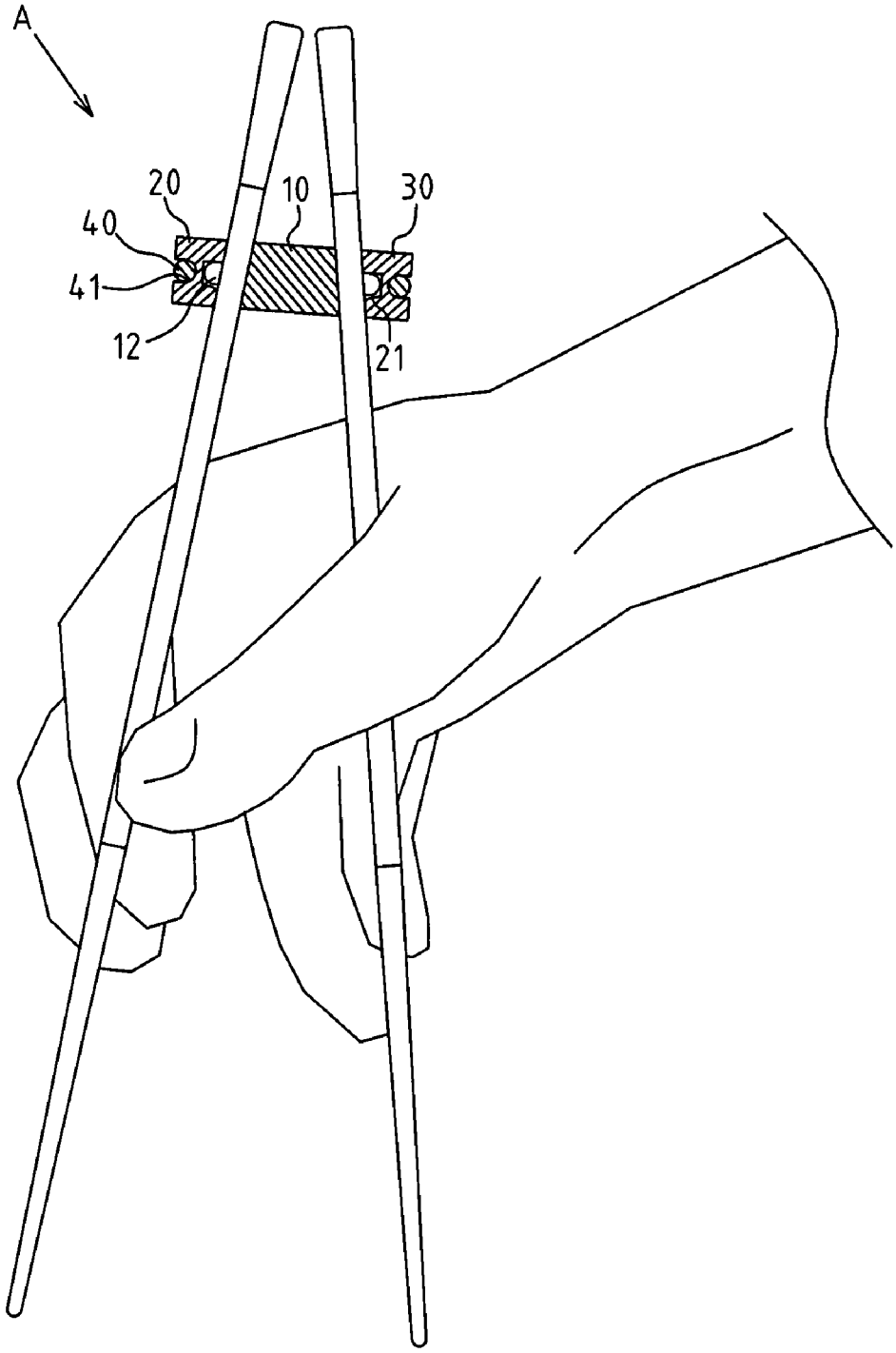
FIG. 7 shows a schematic view of the application of the present invention.

Referring to FIG. 7, users manually hold the chopsticks gripper A in a correct manner.

I claim:

1. A chopsticks gripper comprising:

an intermediate block having a top and a bottom and four sides, said intermediate block having a first angled internal gripping slot formed on one side of said four sides thereof and a second angled internal gripping slot formed on an opposite side of said four sides;

a left clamp splice positioned on said one side of said intermediate block, said left clamp splice having a first angled external gripping slot formed thereon, said first angled external gripping slot aligning with said first angled internal gripping so as to define a through hole;

a right clamp splice positioned on the said opposite side of said intermediate block, said right clamp splice having a second angled external gripping slot formed thereon, said second angled external gripping slot aligning with said second angled internal gripping slot so as to define a through hole; and a flexible sleeving member sleeved onto said intermediate block and around said left clamp splice and right clamp splice such that said left clamp splice and said right clamp splice are flexibly positioned relative to said intermediate block.

2. The chopsticks gripper of claim 1, the one side of said intermediate block having a pair of lugs extending outwardly therefrom, the opposite side of said intermediate block having a pair of lugs extending outwardly therefrom, said left clamp splice having a groove formed therein, said groove receiving said pair of lugs of the one side of said intermediate block therein, said right clamp splice having a groove formed therein, said groove of said right clamp splice receiving said pair of lugs of the opposite side of said intermediate block therein.

3. The chopsticks gripper of claim 1, said four sides of said intermediate block further comprising a front side and a rear side, each of said front side and said rear side having a recessed notch formed therein, said left clamp splice and said right clamp splice having a recessed notch formed therein, said flexible sleeve received in said recessed notches.

* * * * *